US006591464B2

(12) United States Patent
Lin

(10) Patent No.: US 6,591,464 B2
(45) Date of Patent: Jul. 15, 2003

(54) ZIPPER SLIDE OF ZIP FASTENER

(76) Inventor: Yu-Pau Lin, No.151, Kung Erh Road, Wu Lin Tsuen, Lung Tan Hsiang, Tao Yuan Hsien (TW)

( * ) Notice: Subject to any disclaimer, the term of this patent is extended or adjusted under 35 U.S.C. 154(b) by 0 days.

(21) Appl. No.: 10/095,092

(22) Filed: Mar. 12, 2002

(65) Prior Publication Data

US 2002/0189057 A1 Dec. 19, 2002

Related U.S. Application Data

(63) Continuation-in-part of application No. 09/883,283, filed on Jun. 19, 2001.

(51) Int. Cl.[7] ..... A44B 19/30; A44B 19/26

(52) U.S. Cl. ..... 24/421; 24/420; 24/419; 24/424; 24/422; 24/433

(58) Field of Search ..... 24/420, 421, 422, 24/423, 424, 419, 429, 433, 436, 425

(56) References Cited

U.S. PATENT DOCUMENTS 3,813,736 A * 6/1974 Fukuroi ..... 24/421
4,679,281 A * 7/1987 Ishii et al. ..... 24/422
5,544,394 A * 8/1996 Yaguramaki ..... 24/424
5,625,928 A * 5/1997 Terada et al. ..... 24/421
5,729,874 A * 3/1998 Mizuno ..... 24/429
5,809,622 A * 9/1998 Yaguramaki ..... 24/421
5,848,455 A * 12/1998 Ikehara et al. ..... 24/422
5,884,373 A * 3/1999 Kawamura ..... 24/421
6,314,624 B1 * 11/2001 Lin ..... 24/421

* cited by examiner

*Primary Examiner*—Victor Sakran
(74) *Attorney, Agent, or Firm*—Rosenberg Klein & Lee

(57) ABSTRACT

A zipper slide is constructed to include a slide, the slide having a front recessed hole, a rear through hole, and stop means in the front recessed hole, a hook plate, the hook plate having a front fulcrum positioned in the front recessed hole and a wedged rear hook for inserting into the rear through hole to engage the interlocking teeth of zipper tapes to which the slide is fastened, a elastic member adapted to force the hook plate into the front through hole, a pull-tab coupled to the hook plate, and a locating plate stamped into the front recessed hole to hold the elastic member and the hook plate in place, the locating plate having protruded portions engaged with the stop means of the slide.

8 Claims, 8 Drawing Sheets

ZIPPER SLIDE OF ZIP FASTENER

This is a continuation-in-part of application Ser. No. 09/883,283 filed Jun. 19, 2001.

BACKGROUND OF THE INVENTION

1. Field of the Invention

The present invention relates to a zipper slide of a zip fastener and, more specifically, to a zipper slide of a zip fastener, which is assembled automatically, and reduced the cost of assembly, and the hook plate is stably engaged on the teeth of the zipper, and the locating plate is strongly fastened in the slide of the zipper slide.

2. Description of the Related Art

FIG. 1 shows a zipper slide of a zip fastener constructed according to the prior art. The zipper slide 1 comprises a slide 10 coupled to the interlocking teeth of zipper tapes, a hook plate 11 pivoted to the slide 10 by a rivet 111, a pull-tab 13 coupled to the slide 10 for pulling by hand to close/open the interlocking teeth of the zipper tapes, and a elastic 12 fastened to one end of the hook plat 11. The rivet 111 is pivoted to a middle part of the hook plate 11. The hook plate 11 is turned about the rivet 111, having a rear end supported on the spring 12 in a recessed hole in the slide 10 and a front end terminating in a hook 112. When the user released the pull-tab 13, the spring 12 imparts a pressure to the hook plate 11, thereby causing the hook 112 to be forced inwardly through a hole in the slide 10 into engagement with the interlocked teeth of the zipper tapes to lock the zipper slide 1. Because the rivet 111 must be set into position manually before riveting, an automatic machine cannot achieve the assembly process of the zipper slide 1 fully automatically. Further, the hook 112 of the hook plate 11 tends to be forced out of the interlocked teeth of the zipper tapes accidentally.

SUMMARY OF THE INVENTION

The present invention has been accomplished to provide a zipper slide of a zip fastener, which eliminates the aforesaid problem. It is one object of the present invention to provide a zipper slide of zip fastener, which is suitable for automatic fabrication with less labor. It is another object of the present invention to provide a zipper slide of a zip fastener, which is strongly fastened in the slide without loosening or sliding. To achieve this and other objects of the present invention, the zipper slide of a zip fastener comprises a slide, the slide having a front recessed hole, a rear through hole, and stop means in the front recessed hole, a hook plate, the hook plate having a front fulcrum positioned in the front recessed hole and a wedged rear hook for inserting into the rear through hole to engage the interlocking teeth of zipper tapes to which the slide is fastened, a elastic member adapted to force the hook plate into the front through hole, a pull-tab coupled to the hook plate, and a locating plate stamped into the front recessed hole to hold the elastic member and the hook plate in place, the locating plate having protruded portions engaged with the stop means of the slide.

DETAILED DESCRIPTION OF THE PREFERRED EMBODIMENT

Figure 1:
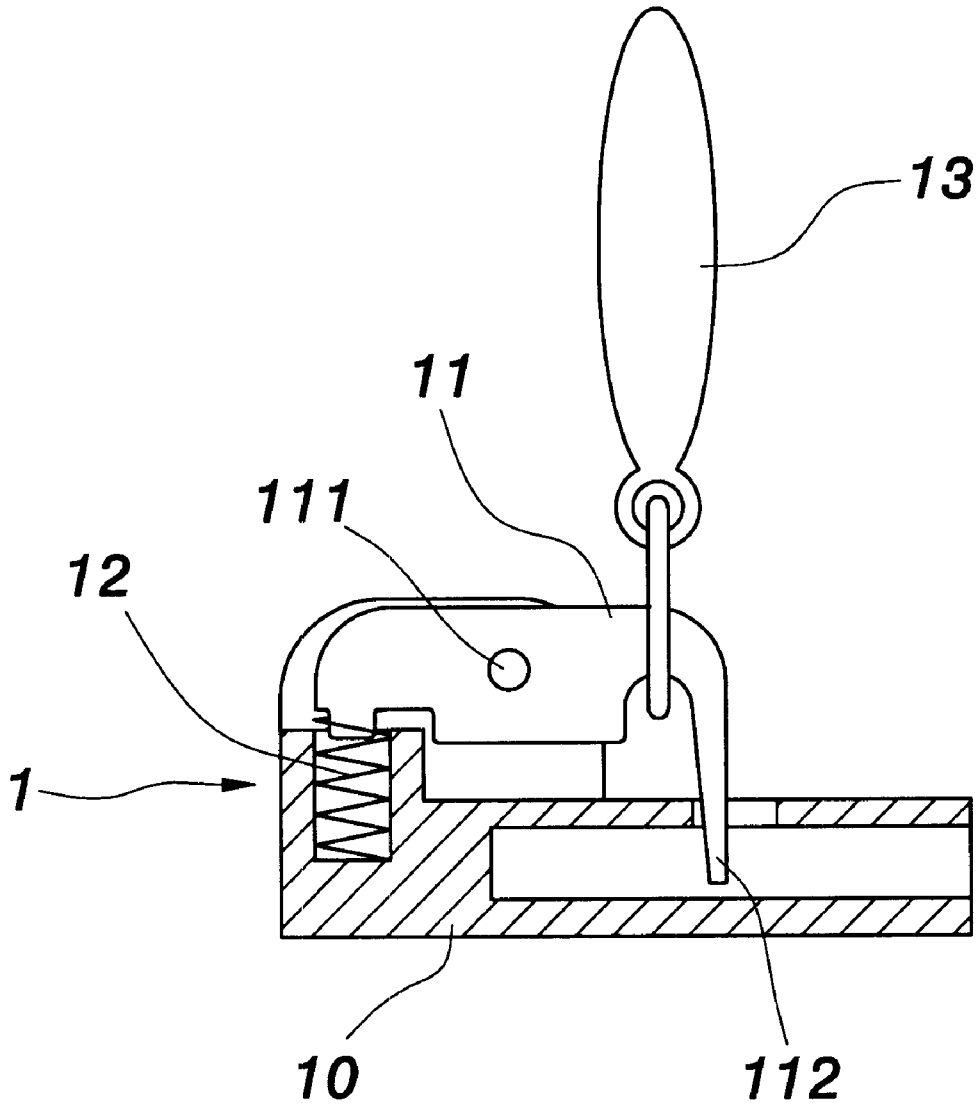
FIG. 1 PRIOR ART
FIG. 1 is a sectional view of a zipper slide of a zip fastener according to the prior art.

Referring to FIGS. from 2 through 5, a zipper slide 70 of a zip fastener in accordance with a first embodiment of the present invention is shown comprised of a slide 20, a hook plate 30, a elastic member 40, a locating plate 50, and a pull-tab 60.

The slide 20 is made of aluminum or zinc alloy, comprising two sliding ways 21 for receiving the interlocking teeth of the zipper tapes (not shown), and a partition block 22 longitudinally disposed between the sliding ways 21. The partition block 22 comprises a front recessed hole 23 and a rear through hole 24 adapted to receive the hook plate 30, and two stop rods 25 bilaterally disposed in the front recessed hole 23.

Figure 4:
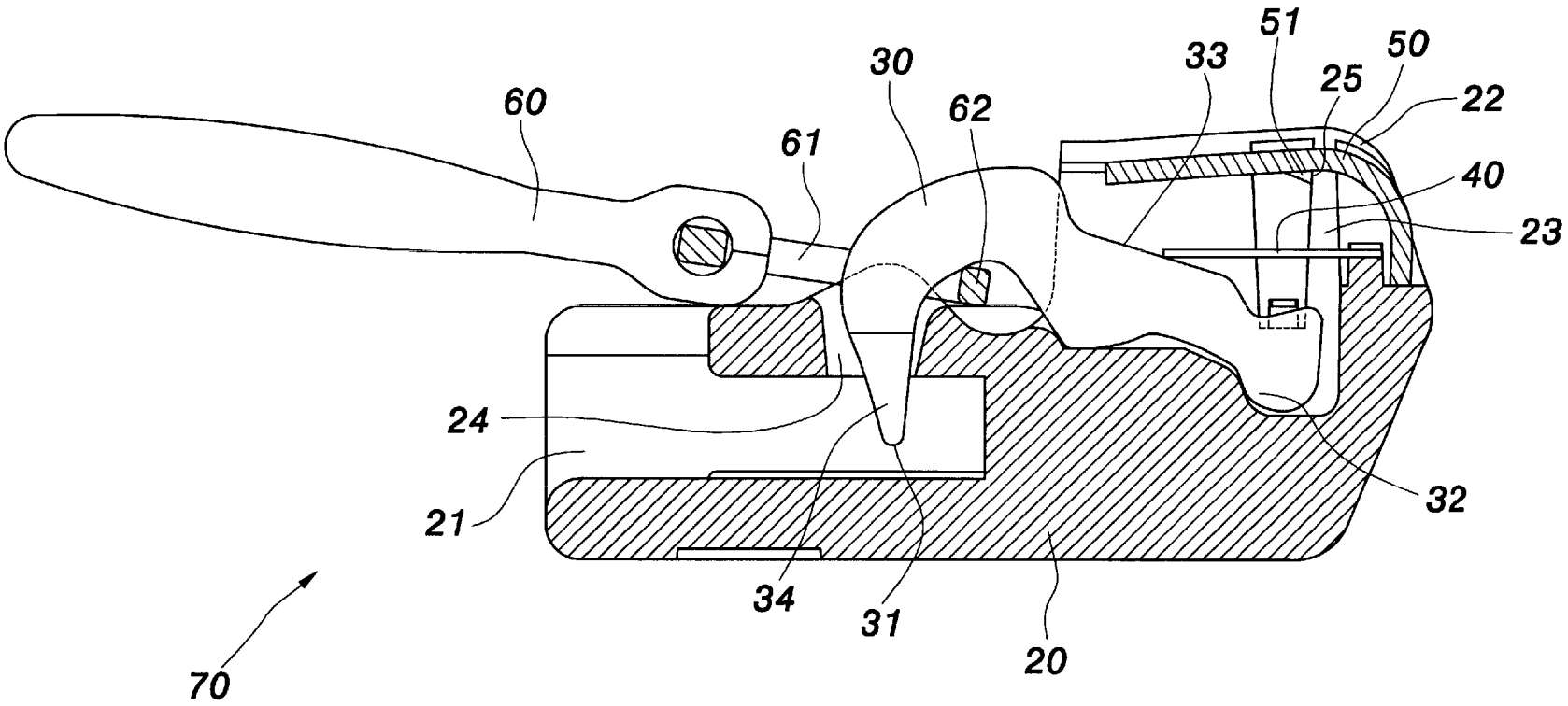
FIG. 4 is a side view in section of the zipper slide of a zip fastener according to the first embodiment of the present invention.
Figure 8:
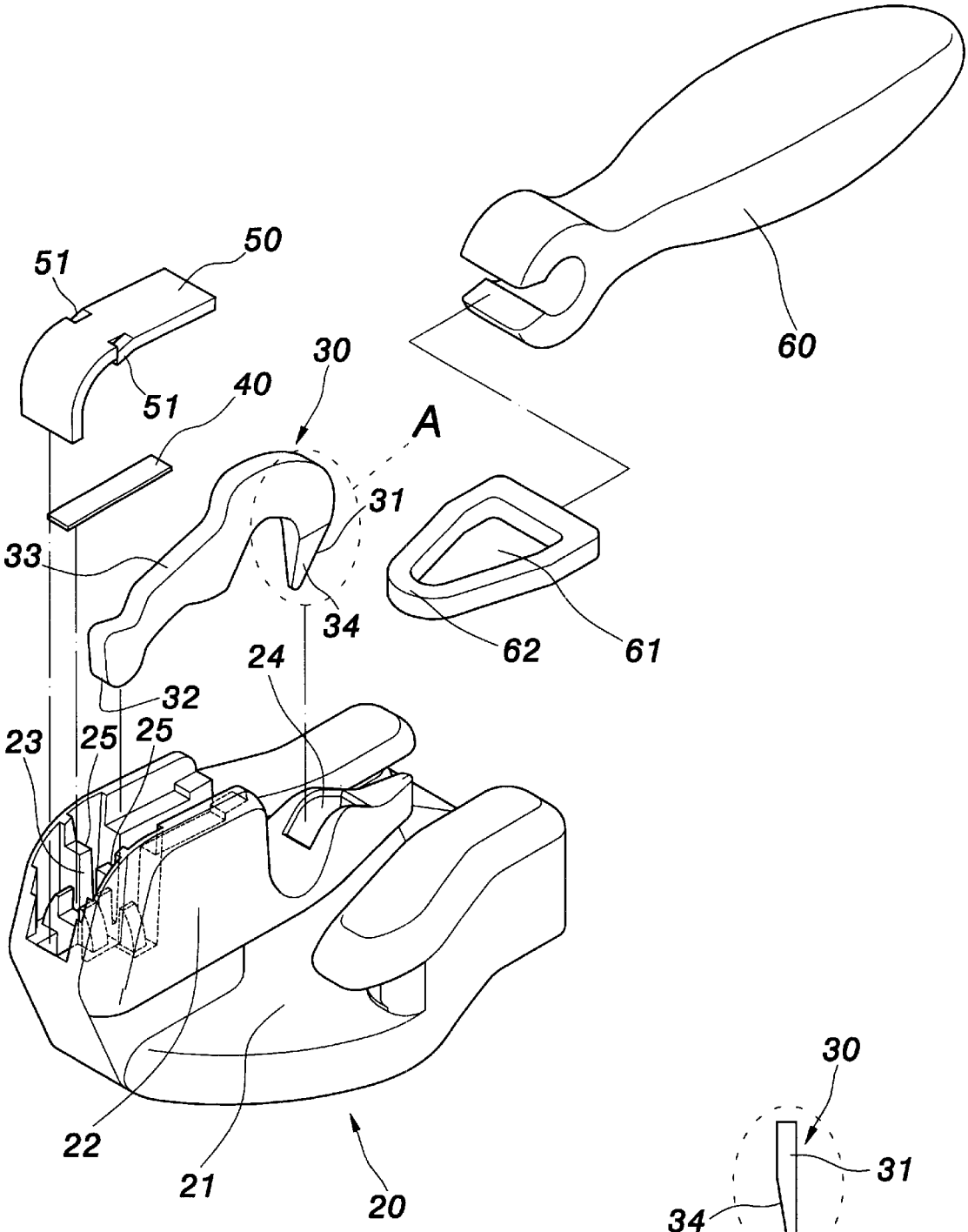
FIG. 8 is an exploded view of a zipper slide of a zip fastener according to a fourth embodiment of the present invention.
Figure 8A:
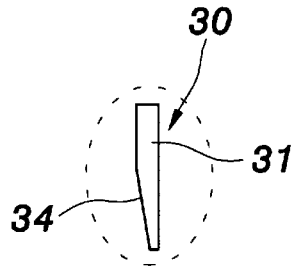
FIG. 8A is an end view of part A of FIG. 8.

The hook plate 30 is made of aluminum or zinc alloy, having a front end terminating in a fulcrum 32, which is positioned in the front recessed hole 23 of the partition block 22 of the slide 20 (see FIG. 4), a rear end terminating in a hook 31, and a top side forming a bearing face 33, which supports the elastic member 40. The hook 31 has at least one bevel face 34 (see FIG. 2A). According to the first embodiment of the present invention, the bevel face 34 is disposed at the left side of the hook 31. In the embodiment shown in FIGS. 8 and 8A, the bevel face 34 is disposed at the right side of the hook 31.

The pull-tab 60 is made of aluminum or zinc alloy and marked with a trademark or logo, having an oval ring 62 coupled to the front end thereof. The hook 31 of the hook plate 30 is inserted through the inner hole 61 of the oval ring 62 into the rear through hole 24 of the slide 20. When installed, the pull-tab 60 can be pulled to move the hook plate 30 and the slide 20.

Figures 2, 2A:
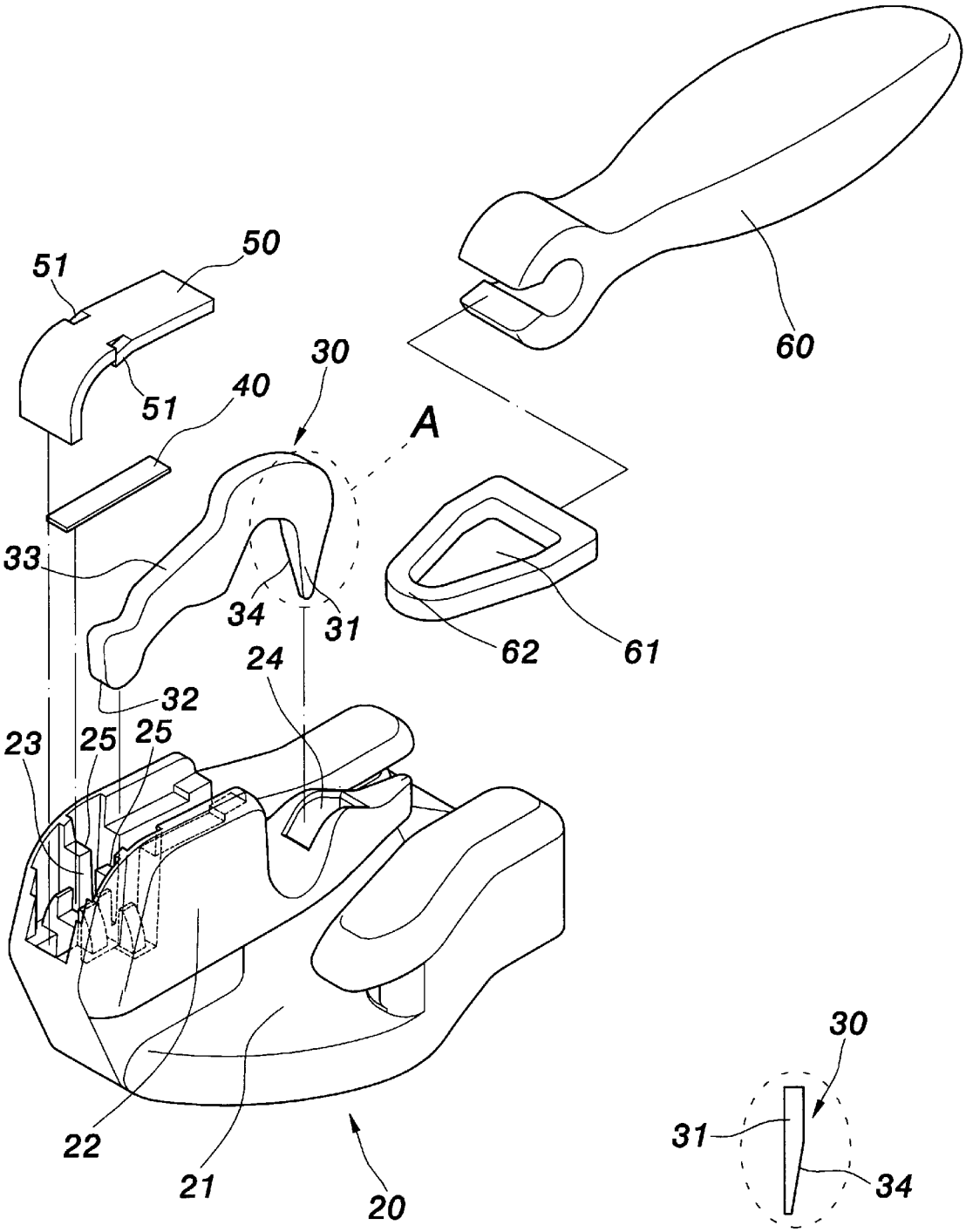
FIG. 2 is a perspective exploded view of a zipper slide of a zip fastener according to a first embodiment of the present invention.
FIG. 2A is an end view of part A of FIG. 2.
Figure 3:
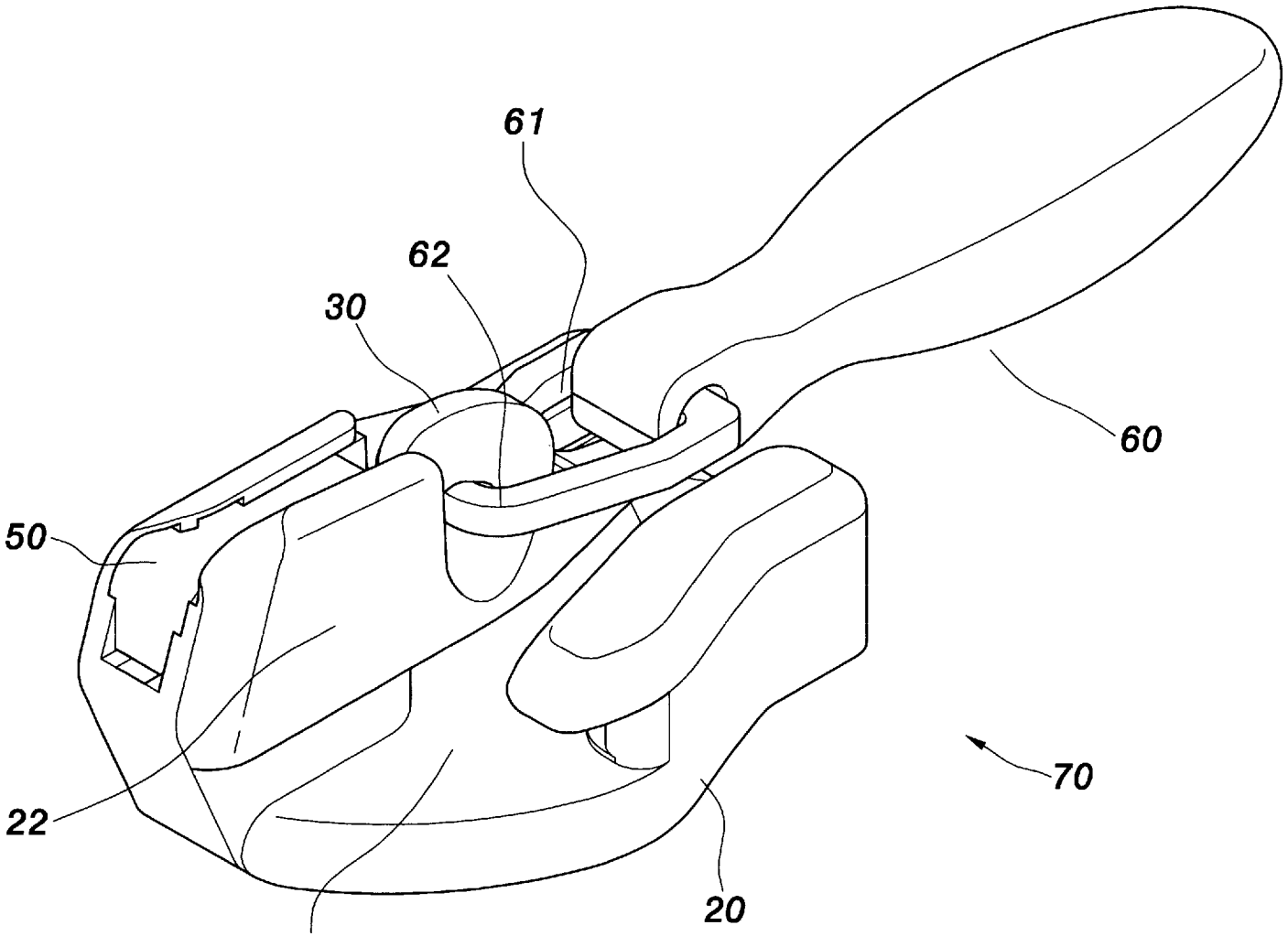
FIG. 3 is an elevational view of the zipper slide of a zip fastener according to the first embodiment of the present invention.
Figure 5:
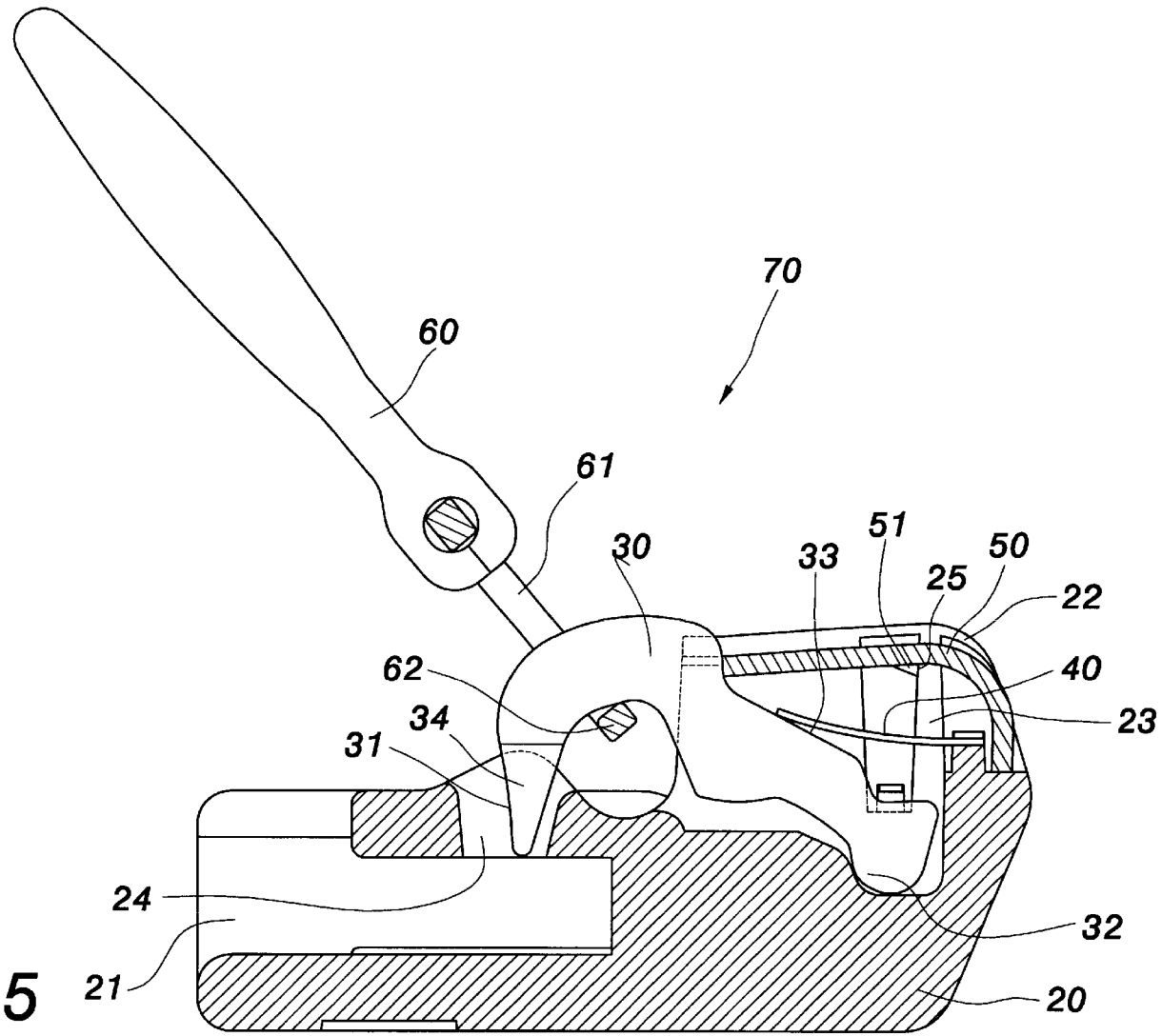
FIG. 5 is similar to FIG. 4 but showing the pull-tab pulled.
Figure 6A:
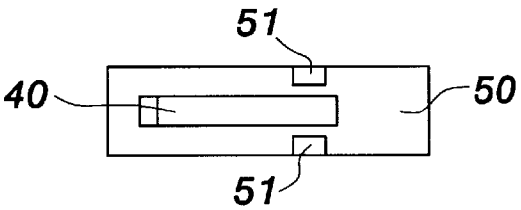
FIG. 6A is top view of a part of the zipper slide of a zip fastener according to the second embodiment of the present invention.
Figure 6:
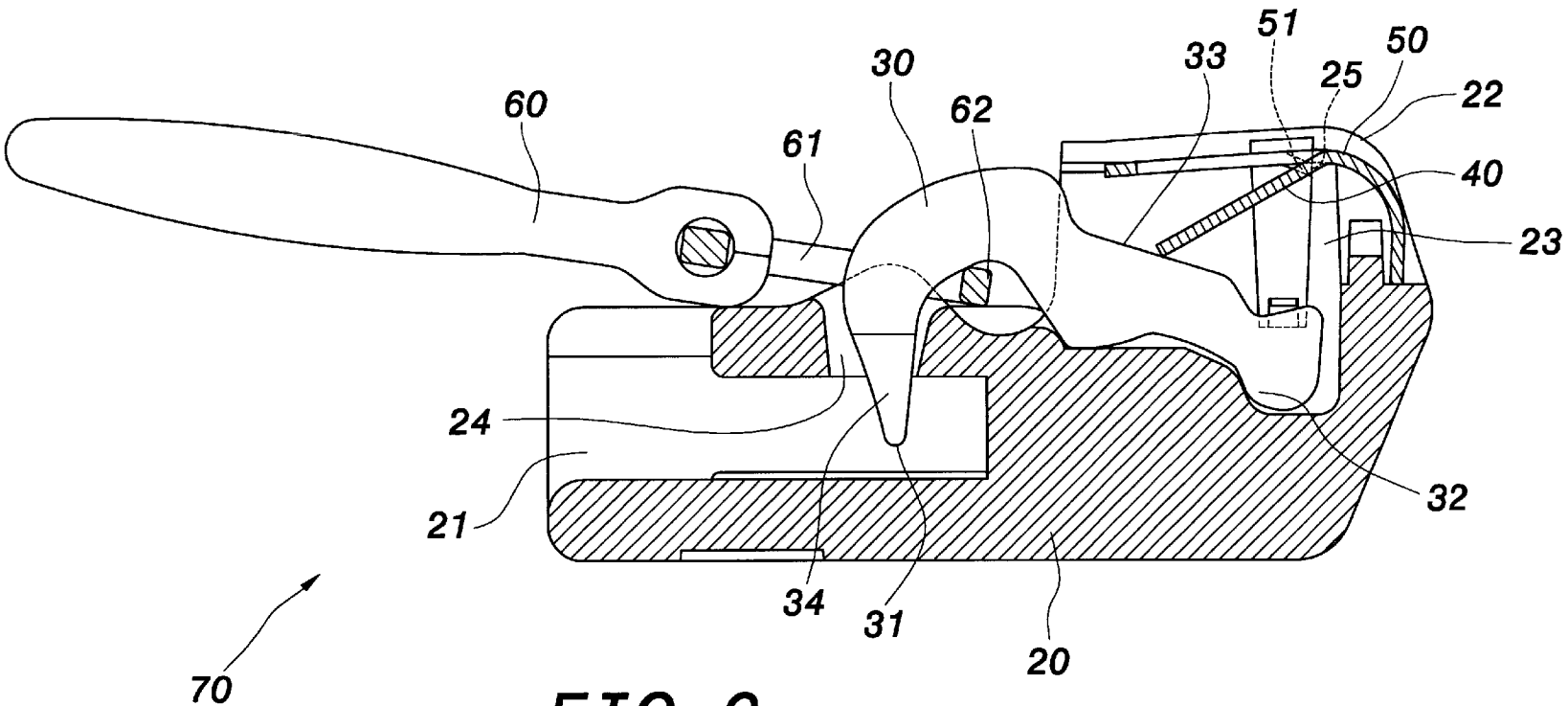
FIG. 6 is a sectional view of a zipper slide of a zip fastener according to a second embodiment of the present invention.
Figure 7A:
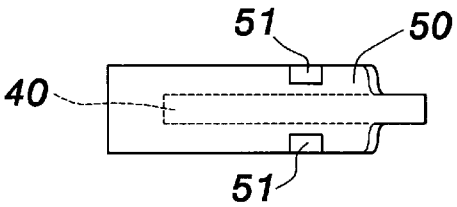
FIG. 7A is top view of a part of the zipper slide of a zip fastener according to the third embodiment of the present invention.
Figure 7:
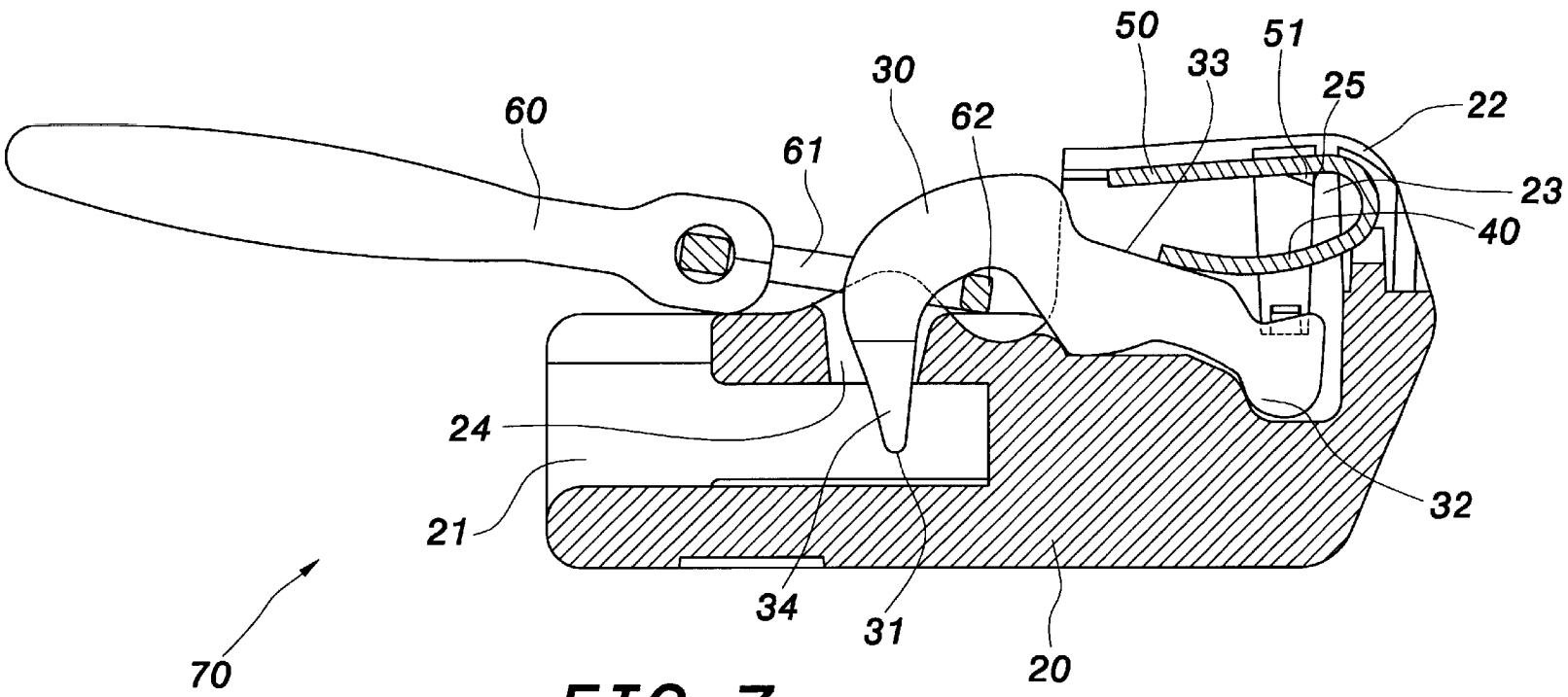
FIG. 7 is a sectional view of a zipper slide of a zip fastener according to a third embodiment of the present invention.

The elastic member 40 is made of resilient metal having high elastic power. It can be variously shaped. For example, the elastic member 40 shown in FIG. 2 is a narrow elongated flat elastic plate; the elastic member 40 shown in FIGS. 6 and 6A is a curved clamping plate; the elastic member 40 shown in FIGS. 7 and 7A is a U-shaped elastic plate. The elastic member 40 is stopped at the bearing face 33 of the hook plate 30 to force the hook 31 into the front through hole 24 of the slide 20 (see FIG. 4) to engage the interlocked teeth of the zipper tapes (not shown). When the user pulls the pull tap 60, the hook 31 is lifted from the slide ways 21 and disengaged from the interlocked teeth of the zipper tapes (see FIG. 5).

The locating plate 50 is made of metal, comprising two protruded portions 51 disposed at two sides on the middle. The locating plate 50 is fastened to the front recessed hole 23 of the slide 20 by stamping, to hold the elastic member 40 and the hook plate 30 in the front recessed hole 23 of the slide 20. When installed, the protruded portions 51 of the locating plate 50 are engaged with the stop rods 25 of the slide 20. Because the locating plate 50 is fastened to the slide 20 by stamping to hold the elastic member 40 and the hook plate 30 in position, an automatic machine can fully automatically achieve the assembly process of the zipper slide 70.

Further, because the hook 31 of the hook plate 30 has at least one bevel face 34 at one side, it has a wedge-like shape. When inserted through the front through holes 24 into the sliding ways 21, the hook 31 positively engages the interlocked teeth of the zipper tapes. Because the protruded portions 51 of the locating plate 50 are engaged with the stop rods 25 of the slide 20, the locating plate 50 does not vibrate when the user pulled the pull-tab 60 to move the slide 20.

A prototype of zipper slide of a zip fastener has been constructed with the features of the annexed drawings of FIGS. 2~8. The zipper slide of zip fastener functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A zipper slide of a zip fastener installed in two zipper tapes and moved to close/open interlocking teeth of said zipper tapes, comprising:

a slide, said slide comprising a front recessed hole, a rear through hole, and stop means bilaterally disposed in said front recessed hole;

a hook plate coupled to said slide, said hook plate having a rear end terminating in a hook for inserting into the rear through hole of said slide to engage the interlocking teeth of said zipper tapes, said hook having at least one bevel face at one side;

a elastic member mounted in the front recessed hole of said slide and stopped at said hook plate to force the hook of said hook plate into the rear through hole of said slide;

a pull-tab coupled to said hook plate; and a locating plate stamped into the front recessed hole of said slide to hold said elastic member and said hook plate in place, said locating plate having protruded portions engaged with the stop means of said slide.

2. The zipper slide of zip fastener as claimed in claim 1, wherein said slide has sliding ways for the passing of the interlocking teeth of said zipper tapes.

3. The zipper slide of zip fastener as claimed in claim 1, wherein said slide comprises a partition block longitudinally disposed on the middle, said partition block defining said front recessed hole and said rear through hole.

4. The zipper slide of zip fastener as claimed in claim 1, wherein said hook plate has a front end terminating in a fulcrum, which is positioned in the front recessed hole of said slide.

5. The zipper slide of zip fastener as claimed in claim 1, wherein said hook plate has a top side forming a bearing face, which supports one end of said elastic member.

6. The zipper slide of zip fastener as claimed in claim 1, wherein said elastic member is a narrow elongated flat a curved clamping plate or a U-shaped elastic plate.

7. The zipper slide of zip fastener as claimed in claim 1, wherein said pull-tab is marked with a commercial design.

8. The zipper slide of zip fastener as claimed in claim 1, wherein said pull-tab comprises a front coupling ring coupled to the hook of said hook plate.

* * * * *